US006606765B2

(12) United States Patent
Edmondson

(10) Patent No.: US 6,606,765 B2
(45) Date of Patent: Aug. 19, 2003

(54) COILED TIE-DOWN DEVICES

(76) Inventor: Ben C. Edmondson, 1972 San Luis Dr., San Louis Obispo, CA (US) 93401

( * ) Notice: Subject to any disclaimer, the term of this patent is extended or adjusted under 35 U.S.C. 154(b) by 0 days.

(21) Appl. No.: 10/032,360

(22) Filed: Dec. 21, 2001

(65) Prior Publication Data

US 2003/0115721 A1 Jun. 26, 2003

(51) Int. Cl.[7] ..... F16B 21/06

(52) U.S. Cl. ..... 24/265 CD; 24/16 PB; 24/129 R

(58) Field of Search ..... 24/16 PB, 265 CD, 24/30.5 R, 20 R, 68 CD, 69 CT, 129 R, 131 R, 131 C, 115 N, 265 H, 909

(56) References Cited

U.S. PATENT DOCUMENTS

| | | | | | |
|---|---|---|---|---|---|
| 1,519,854 | A | | 12/1924 | Lockwood | |
| 2,798,507 | A | * | 7/1957 | St. Clair | 236/34 |
| 3,130,633 | A | | 4/1964 | Dawes | 87/2 |
| 4,234,378 | A | | 11/1980 | Iwasaki et al. | 162/138 |
| 4,308,155 | A | | 12/1981 | Tada et al. | 252/62.54 |
| 4,425,292 | A | | 1/1984 | Kanotz | 264/174 |
| 4,513,063 | A | | 4/1985 | Hashi et al. | 428/377 |
| 4,549,332 | A | * | 10/1985 | Pouliot | 24/115 H |
| 4,569,108 | A | | 2/1986 | Schwab | 24/17 R |
| 4,575,906 | A | * | 3/1986 | Larsen | 223/85 |
| 4,788,089 | A | * | 11/1988 | Skipper | 138/129 |
| 4,883,552 | A | | 11/1989 | O'Connor et al. | 156/180 |
| 5,003,672 | A | | 4/1991 | Randall | 24/300 |
| 5,035,558 | A | * | 7/1991 | Prosen | 24/130 |
| 5,274,933 | A | * | 1/1994 | Cole et al. | 36/136 |
| 5,325,568 | A | | 7/1994 | Bruhm | 24/301 |
| 5,383,259 | A | | 1/1995 | McIntire | 24/300 |
| 5,449,151 | A | * | 9/1995 | Johnson | 114/215 |
| 5,515,580 | A | | 5/1996 | McHenry, Jr. | 24/16 PB |
| 5,597,196 | A | * | 1/1997 | Gibbs | 160/326 |
| 5,607,736 | A | | 3/1997 | Williams | 428/36.3 |
| 5,769,796 | A | * | 6/1998 | Palermo et al. | 600/433 |
| 5,797,167 | A | | 8/1998 | Schwab | 24/16 R |
| 6,014,794 | A | | 1/2000 | Mc Coy | 24/300 |
| 6,099,060 | A | | 8/2000 | Towers | 294/159 |
| 6,117,168 | A | * | 9/2000 | Yang et al. | 623/1.44 |
| 6,381,939 | B1 | * | 5/2002 | Brown et al. | 24/122.6 |

OTHER PUBLICATIONS

Garden Coil, publication without author, publisher or date, one page (best copy available).

* cited by examiner

*Primary Examiner*—Robert J. Sandy
*Assistant Examiner*—André L. Jackson
(74) *Attorney, Agent, or Firm*—Albert J. Dalhuisen

(57) ABSTRACT

The present invention provides tie-down devices and techniques for securing an object to a structure. The tie-down devices are formed using helix shaped elongate members including multiple coils having substantially the same dimensions and configuration. A double helix elongate member connection is prepared by securing one segment of the elongate member upon another segment. An elongate member can be utilized to secure an object to a structure by stretching the elongate member across the object, and then tying the elongate member to the structure by forming one or more elongate member connections without using fastening elements such as hooks. Separate elongate members can be joined by means of the elongate member connections provided that the elongate members include coils having substantially the same dimensions and configuration. Side surfaces of elongate member coils can be provided with a slip resistant surface. Optimally, elongate member connection retainers are provided to further strengthen the elongate member connection. A variety of materials and techniques can be employed to fabricate elongate members suitable for tie-down devices of the present invention.

22 Claims, 6 Drawing Sheets

COILED TIE-DOWN DEVICES

FIELD OF THE INVENTION

The present invention relates to coil shaped tie-down devices.

BACKGROUND OF THE INVENTION

A variety of strap and cord devices are available for removably tying down an object to a support or structure. Typically, these devices are adapted for maintaining tension in the device, in order to more securely tie the object to the support. For example tie-down devices include elastomeric straps, see for example U.S. Pat. No. 5,325,568 (Bruhm, 1994), elastomeric cords, see for example U.S. Pat. No. 6,014,794 (Mc Coy, 2000), flexible curled cords, see for example U.S. Pat. No. 5,515,580 (McHenry Jr., 1996) and coiled springs, see for example U.S. Pat. No. 1,519,854 (Lockwood, 1924).

Known tie-down devices also include devices having an elastic elongate member as well as a non-elastic elongate member, see for example the '794 patent. A variety of fastening implements or fasteners are known for attaching a tie-down to a support, a load such as a package, or for fastening the tie-down device to itself and thereby forming a loop. These fastening implements include hooks, see for example the '794 patent, hook and ring combinations, see for example U.S. Pat. No. 4,569,108 (Schwab, 1986). While many of these fastening devices are attached to the ends of an elongate member, it is also known to employ fastening implements that can be positioned at substantially any point along an elongate fastening member, see for example U.S. Pat. No. 5,383,259 (McIntire, 1995). Generally the fastening implements include rigid components for example metal or rigid plastic. Such rigid implements can mar or damage the surface of an object that is secured by a tie-down. Also, these implements can damage the tie-down device, when the fastening implement is fastened to form a loop in the device.

Typically tie-down devices such as described above are provided in specific lengths, see for example U.S. Pat. No. 6,099,060 (Towers, 2000). But it is also known to employ fastening techniques that allow placement of one or more fasteners along substantially the entire length of the elongate member, thereby enabling a user to employ a selected portion of the elongate member, see for example the '580 and '259 patents.

Prior art tie-down devices and techniques have thus resulted in a variety of useful solutions to common tie-down problems. However, the need exists for improved tie-down devices that provide the capability to secure an object to a structure without utilizing fastening implements or components and wherein the user of the device can employ either a portion or substantially the entire length of the fastening device.

SUMMARY OF THE INVENTION

The present invention provides novel devices and techniques for securing on object to a structure.

In one embodiment of the present invention a tie-down device employs a helix shaped elongate member having multiple coils, wherein the coils have substantially the same dimensions and configuration. A first segment of the elongate member is secured to a second segment of the elongate member, forming a double helix shaped elongate member connection of the present invention. The connection includes first segment coils alternating with second segment coils and first segment coil half sections alternating with second segment coil half sections, such that each first segment coil half section is substantially parallel to the adjacent second segment coil half sections. Optionally, an elongate member connection retainer embodiment of the present invention is provided for retaining at least a portion of the elongate member connection therein.

In another embodiment of the present invention, two or more double helix shaped elongate member connections of the present invention are formed in a helix shaped elongate member by securing two or more segments of the elongate member to two or more other segments of the elongate member.

In a further embodiment of the present invention two helix shaped elongate members including coils having substantially the same dimensions and configuration are joined by securing a segment of one of the elongate members onto a segment of the other elongate member, thereby forming a double helix elongate member connection.

In yet another embodiment of the present invention helix shaped elongate members are formed using helical metal springs that are coated with a flexible polymer, polymeric material reinforced with substantially non-elastic fiber material, or using a nylon compound.

In still another embodiment of the present invention elongate members of are provided slip resistant coil side surfaces.

DETAILED DESCRIPTION OF THE INVENTION

While describing the invention and its embodiments, certain terminology will be utilized for the sake of clarity. It is intended that such terminology include not only the recited embodiments but all equivalents which perform substantially the same function, in substantially the same manner to achieve the same result.

Figure 1:
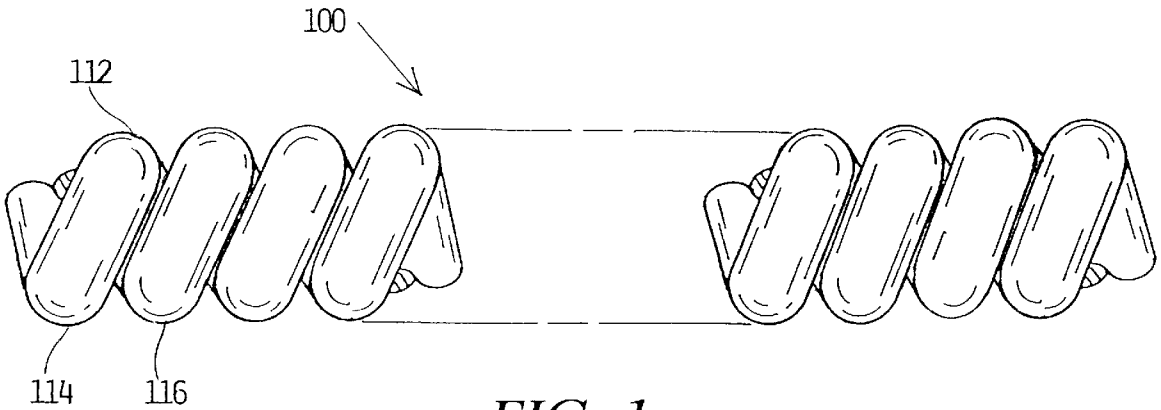
FIG. 1 is a schematic side view illustrating an elongate member of the present invention.
Figure 6:
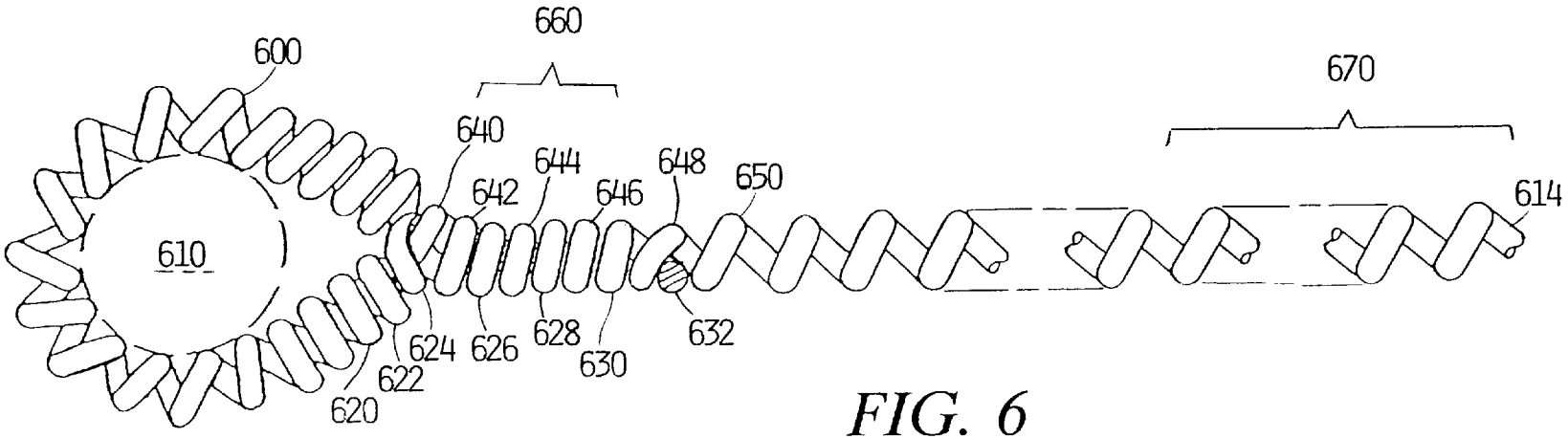
FIG. 6 is a schematic side view illustrating another device of the present invention.
Figure 8:
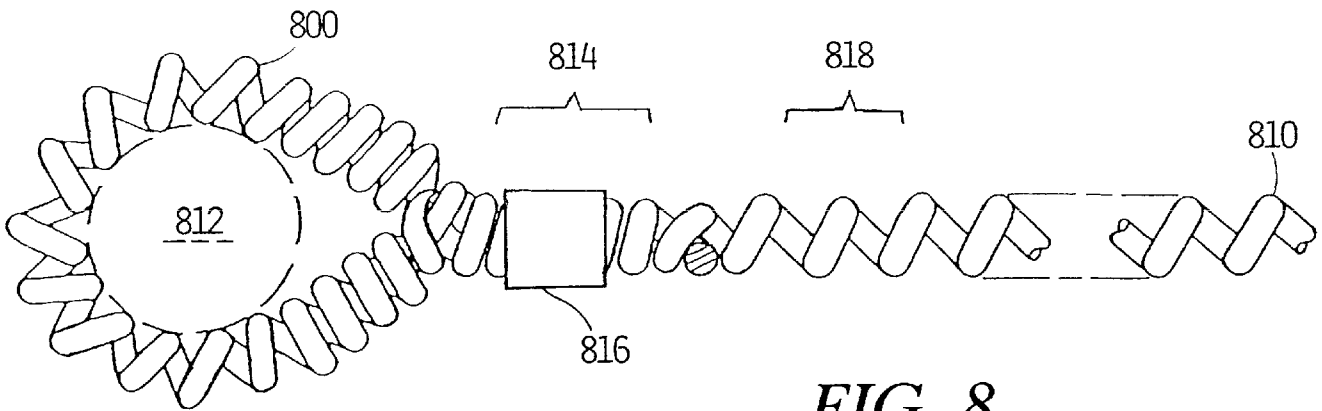
FIG. 8 is a schematic side view illustrating another device of the present invention.
Figure 7:
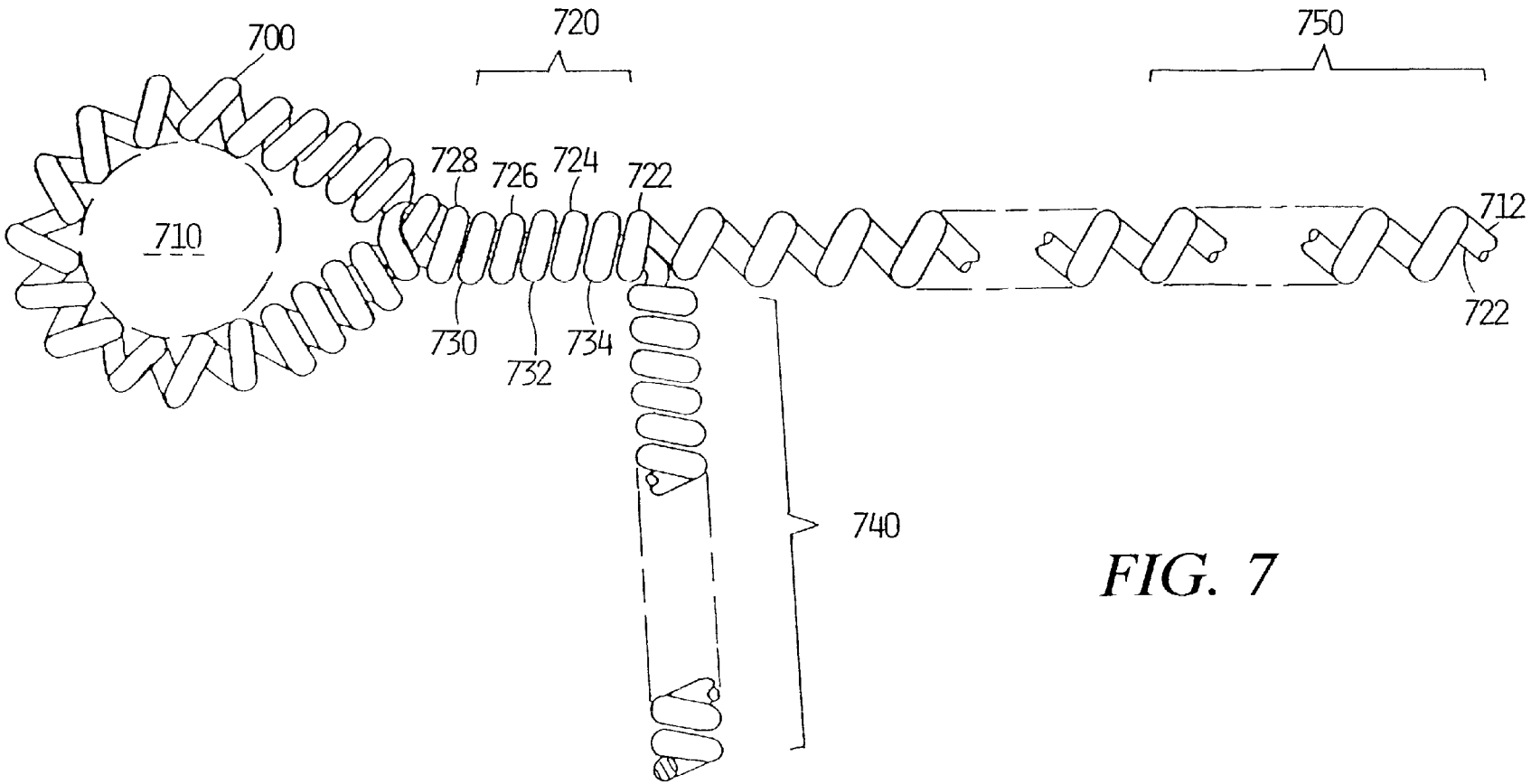
FIG. 7 is a schematic side view illustrating another device of the present invention.

Embodiments of the present invention include tie-down devices such as illustrated in for example FIGS. 6–8, having a coiled or curled elongate member 100. Elongate member 100 is shown in a relaxed state, i.e. without applying a force for extending the elongate member substantially coincident with the longitudinal axis of the device. Elongate members of embodiments of the present invention, such as elongate member 100, include coils that form a spiral or helix around a central longitudinal axis. These devices are substantially cylindrically shaped. The term "coil" as defined herein includes a single spiral or helix shaped turn of the elongate member, such as for example coil 112 extending between positions 114 and 116 of elongate member 110 as shown in FIG. 1. All of the coils of an elongate member of embodiments of the present invention have substantially the same dimensions and configuration.

Figure 2:
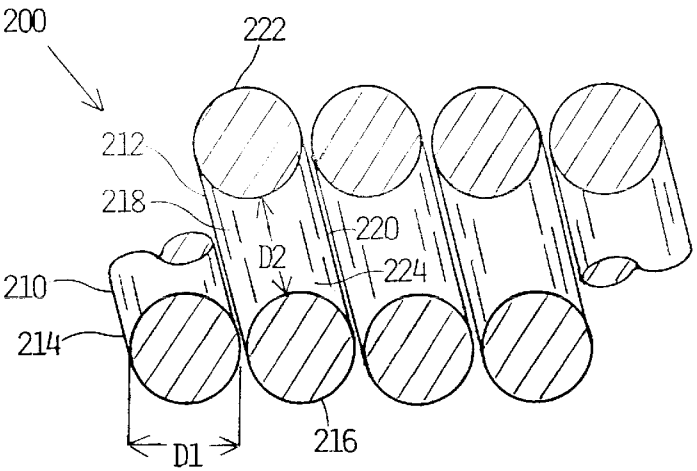
FIG. 2 is a schematic cross sectional side view illustrating a segment of an elongate member of the present invention.

FIG. 2 schematically illustrates a cross sectional segment 200 along the longitudinal axis of elongate member 210 of an embodiment of the present invention, similar to elongate member 100 illustrated in FIG. 1. Coil 212 (FIG. 2) extends between positions 214 and 216 of elongate member 210. Coil stock 218 has a substantially circular cross section having an outside diameter D1, such as is for example shown at position 214 of coil 212. A "coil half section" is provided between opposing positions of a coil. For example, FIG. 2 depicts a coil half section 220 between positions 222 and 216 of coil 212. As illustrated in FIG. 2, an opening extends longitudinally through elongate member 210 because each coil extends around an opening. For example coil half section 220 provides an opening 224, having an inside diameter D2 along the pitch of the helix, around which coil stock 218 is formed. Tie-down devices of the present invention include an opening through the elongate member such that an opening in each coil half section has an inside diameter D2 that is at least equal to the approximate diameter of the coil stock.

Figure 3:
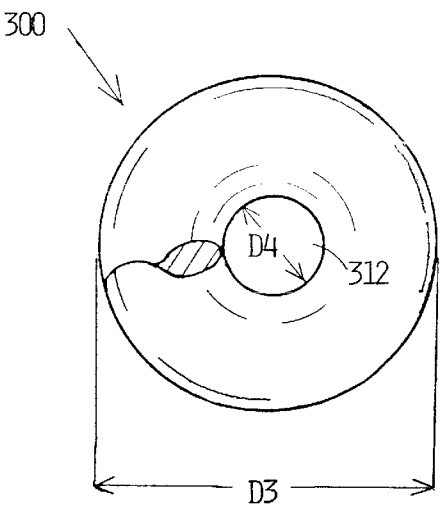
FIG. 3 is a schematic end view of an elongate member of the present invention.

As depicted in the schematic end view shown in FIG. 3, an elongate member segment 300, similar to segment 200 shown in FIG. 2, includes an outer diameter D3 and a central opening 312 having an inside diameter D4. Due to the spiral shape of the elongate member, the opening in the coil half section (i.e. opening 224, FIG. 2) is greater than the central opening of the elongate member (i.e. central opening 312, FIG. 3), in other words D2 is greater than D4.

Elongate members of tie-down devices of the present invention such as described in connection with FIGS. 1–3 are formed such that the coils are deformed mainly in a torsion mode and/or flexing mode and without a substantial elastic mode, when the elongate member is stretched in the direction of its longitudinal axis during such uses as securing an object to a structure. The coil configuration is provided with a coil configuration memory such that stretching the device followed by relaxing the device, results in a coil configuration that is substantially similar in shape and dimensions as the device's shape and dimensions prior to stretching during such uses as securing an object to a structure.

Figure 4A:
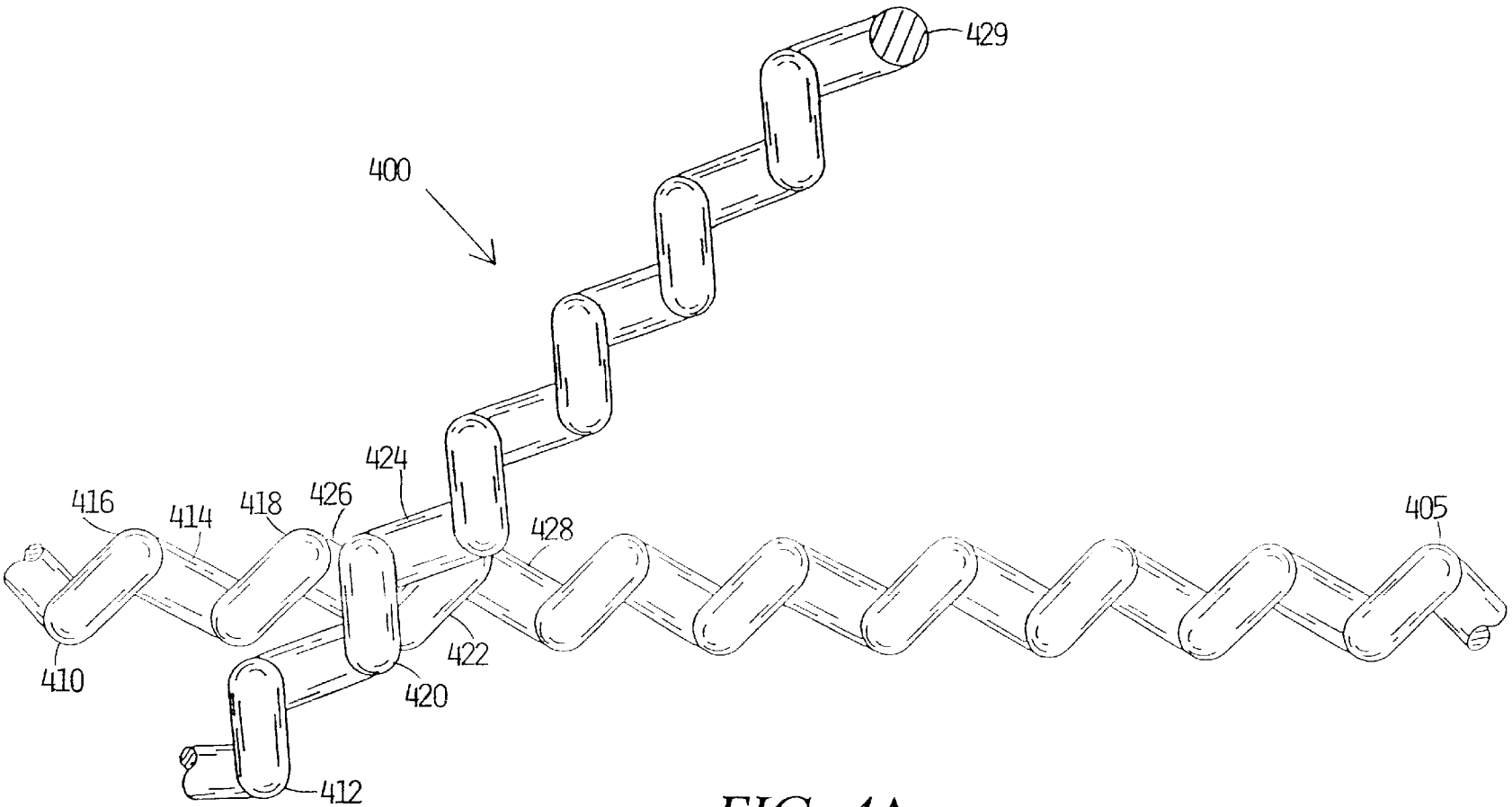
FIGS. 4A and 4B are schematic side views illustrating a device of the present invention at sequential stages.
Figure 4B:
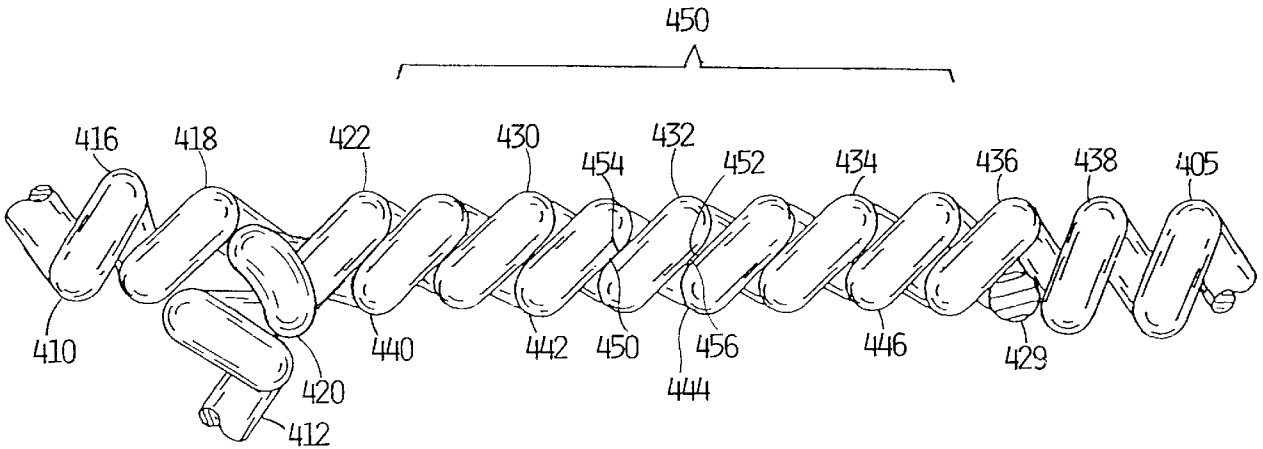

As shown in FIGS. 4A and 4B, an elongate member of a tie-down device of the present invention can be secured upon itself, such that a segment of the elongate member can be secured upon another segment of the member without the use of a fastening implement. FIG. 4A depicts an inventive tie-down device 400 comprising an elongate member 405 similar to elongate members 110, 210 and 310 (see FIGS. 1–3). Elongate member 405 includes segments 410 and 412. Segments 410 and 412 are deformed, mainly through torsion, bending or flexing, such that a space is formed between adjacent coil half sections. See for example space 414 that is formed between adjacent coil half sections 416 and 418 of segment 410. This can be done when the space between adjacent coil sections is at least the approximate diameter of the coil stock. An appropriate portion of segment 412 is then positioned in the space provided between the adjacent coil half sections of device segment 410. For example, coil half section 420 of segment 412 is positioned between coil half section 418 and 422 of segment 410. Coil half section 424 of segment 412 is then positioned (not shown) between coil half sections 426 and 428 of segment 410 by twisting (not shown) the relevant portion of segment 412 around segment 410.

As illustrated in FIG. 4B, segments 410 and 412 of the elongate member of the novel tie-down device are secured upon each other by twisting the segments together to form a double spiral or double helix wherein coil half sections of segment 410 alternate with coil half sections of segment 412. FIG. 4B shows the following coil half sections of segment 410: 416, 418, 422, 430, 432, 434, 436 and 438. Coil half sections of segment 412 that alternate with those of segment 410 include coil half sections 420, 440, 442, 444 and 446. An elongate member connection 450 is thereby formed in the novel device between coil half sections 422 and 446. It is noted that the inventive technique includes locking the two segments together by twisting one segment about another rather than positioning the segments parallel to one another and then attempting to position the coils of one segment between coils of the other segment without twisting one segment around the other segment. As shown in FIGS. 4A and 4B, segment 412 ends at terminal portion 429. This terminal portion is secured between coil half sections 436 and 438 of segment 410.

Figure 5:
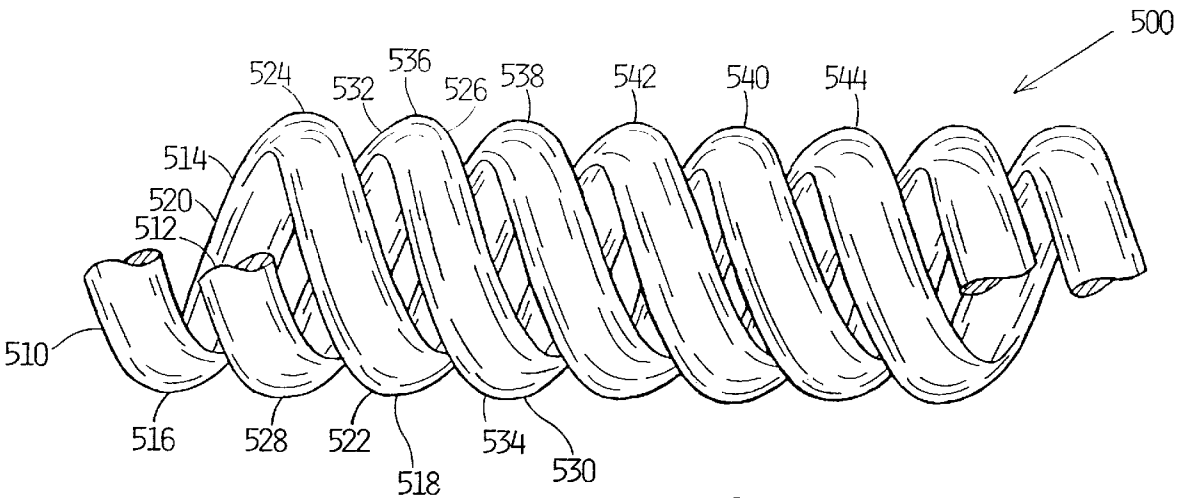
FIG. 5 is a schematic side view illustrating a double helix formed by intertwining two segments of an elongate member of the present invention.

FIG. 5 shows a further illustration of the configuration resulting from intertwining two segments of an elongate member of the present invention. Segments 510 and 512, similar to segments 410 and 412 (FIG. 1), form an inventive elongate member connection 500 according to the technique described in connection with FIGS. 4A and 4B. Returning to FIG. 5, a coil 514 of segment 510 is formed between positions 516 and 518. Coil 514 includes coil half sections 520 and 522 that are formed between positions 516 and 524, and between positions 524 and 518 respectively, wherein position 524 opposes positions 516 and 518. Similarly, a coil 526 of segment 512 is formed between positions 528 and 530. Coil half sections 532 and 534 of coil 526 are formed between positions 528 and 536, and between positions 536 and 530 respectively. In like manner, segment 510 further includes coil half sections 538 and 540, while segment 512 further includes coil half sections 542 and 544. As depicted in FIG. 5, the elongate member connection of the present invention includes adjacent coil half sections of segment 510 alternating with the adjacent coil half sections of segment 512. It is noted that coil half sections of segment 510 are substantially parallel to adjacent coil half sections of segment 512. For example, coil half section 520 of segment 510 is substantially parallel to adjacent coil half section 532 of segment 512. Similarly, coil half section 522 of segment 510 is substantially parallel to adjacent coil half section 534 of segment 512.

The configuration of the two intertwined segments forming an elongate member connection 500 (FIG. 5) provides a double spiral or double helix wherein coils of a first segment alternate with the coils of a second segment such that the coils of the first and second segments are substantially identically shaped in the intertwined portion and such that each coil half section of the first segment is substantially parallel to each adjacent coil half section of the second segment. The elongate member connection includes at least one coil of a first elongate member, or elongate member segment, and at least one adjacent coil of a second elongate member, or elongate member segment, such that each coil half section of the first elongate member is substantially parallel to each adjacent coil half section of the second elongate member. Preferably, elongate member connections of the present invention include at least two coils of a first elongate member or member segment, and at least two coils of a second elongate member or member segment. It will be noted that coils or coil half sections that are positioned at the beginning or at the end of the intertwined section typically lack the above noted similarities between coils or coil half sections of the adjoining segments, see for example coil half section 420 of segment 412 illustrated in FIG. 4B. These coils that lack the above noted similarities between coils or coil half sections of adjoining segments are not included in elongate member connections as defined herein.

It will be noted that portions of side surfaces of adjacent coils and adjacent coil half sections of an elongate member connection that touch one another may cause the touching side surfaces to be somewhat flattened (not shown) as a result of a biasing force in each elongate member due to the coil configuration memory. The extent of surface flattening depends on the biasing force and on the compressibility of the coil or its outer layer.

Elongate member connection 500, depicted in FIG. 5, illustrates a configuration wherein the coils and coil half sections of segment 510 provide little or no contact with the corresponding coils and coil half sections of segment 512. This configuration wherein the coils of one segment make little or no contact with the coils of another segment, can occur when the elongate member is stretched at the time when the user is forming the elongate member connection. Once a tie-down device of the present is in place to secure an object to a structure, portions of the side surfaces of adjacent coils and adjacent coil half sections of an elongate member connection typically touch one another. For example, as shown in FIG. 4B, side surface portions 450 and 452 of coil half section 421 touch portion 454 of adjacent coil half section 442 and portion 456 of coil half section 444 respectively. Upon further stretching of elongate member connection 450, gaps will be formed in connection 450 such that the side surface of each coil half section of one segment touches only one coil half section of the other segment. The expressions "coil side surface" and "coil half section side surface" when used in the context of the present invention refer to those surfaces that comprise facing an adjoining coil or coil half section.

Another embodiment of the present invention schematically depicted in FIG. 6, shows a tie-down device 600 that is secured to a structure 610 according to the techniques described in connection with FIGS. 4A, 4B and 5. Device 600 comprises an elongate member 614 that is wrapped or guided around structure 610. An end segment of member 614 includes coil half sections 620, 622, 624, 626, 628, 630 and terminal portion 632. The end segment is secured upon elongate member 614 by twisting it around the elongate member, as described in connection with FIGS. 4A and 4B, resulting in (1) securing end segment coil half section 626 between coil half section 642 and 644 of member 614, (2) securing end segment coil half section 628 between coil half sections 644 and 646, (3) securing end segment coil half section 630 between coil half sections 646 and 648 of member 614 and (4) securing end portion 632 of the end segment between coil half sections 648 and 650 of elongate member 614. It will be understood that the engagement of the end segment with the elongate member can be achieved by inserting an end segment coil, such as coil 624 of device 600 (FIG. 6) between two adjacent coils (not shown) or by inserting the end segment coil in an overlapping manner wherein the coil such as coil 624 overlaps two coils such as coils 640 and 642 of elongate member 614. An elongate member connection 660 of device 600 is formed between coil half sections 642 and 630, see FIG. 6. Device 600 can be employed to secure an object (not shown) to structure 610 by securing the object to segment 670 of the device.

A further embodiment of the present invention schematically illustrated in FIG. 7 shows a tie-down device 700, comprising an elongate member 712 that is tied to a structure or attachment position 710. The elongate member is secured to itself by forming an elongate member connection 720, similar to elongate member connection 660 described in connection with FIG. 6. Elongate member 712, shown in FIG. 7, ranges from coil half section 721, through coil half sections 722, 724, 726 and 728 of elongate member connection 720, around structure 710, through coil half sections 730, 732 and 734 of connection 720 through elongate member segment 740, ending at terminal position 742. Segment 750 can be secured to an object or structure (not shown) by securing segment 750 to itself (not shown), similar to the manner in which elongate member connection 720 is formed.

The inventive techniques described in connection with FIG. 7 show that tie-down devices of the present invention are adapted for forming a connection for securing elongate member segments together without requiring an end segment in order to form the connection. The inventive techniques and devices thus enable the user to employ a portion of the device rather than its entire length. Advantageously, tie-down devices of the present invention do not require a specific length for tying down an object, requiring only that the length be at least sufficient to form the elongate member connection. Furthermore, separate elongate members can be connected to extend the length of an elongate member, for example by forming an elongate member connection such as connection 450 (FIG. 4) or connection 720 (FIG. 7) between two separate elongate members, provided the separate elongate members include coils having substantially the same diameter and configuration.

FIG. 8 illustrates an additional embodiment of the present invention providing a tie-down device 800. This device includes an elongate member 810 that is secured to a structure 812. Elongate member 810 is secured upon itself, forming elongate member connection 814, in the manner described in connection with tie-down devices 600 and 700 illustrated in FIGS. 6 and 7. Returning to FIG. 8, device 800 additionally includes an elongate member connection retainer 816 for retaining at least a portion of elongate member connection 814 therein. Connection retainer 816 comprises a tube that is adapted for slidably fitting on the outside of elongate member 810. Placement of connection retainer 816 around elongate member connection 814 results in a stronger elongate member connection.

The retainer can be positioned on the elongate member prior to securing the member to a structure. For example, connection retainer 816 can be placed at section 818 (FIG. 8) of elongate member 810 prior to securing the elongate member to the structure. Retainer 816 can then be moved to elongate member connection 814 once this has been formed. Preferably, the connection retainer fits snugly on the elongate member, since stretching the elongate member results in a reduction of its outside diameter. The retainer and the elongate member can be provided separately in kit form to provide the user with an optional use of a connection retainer.

Figure 9:
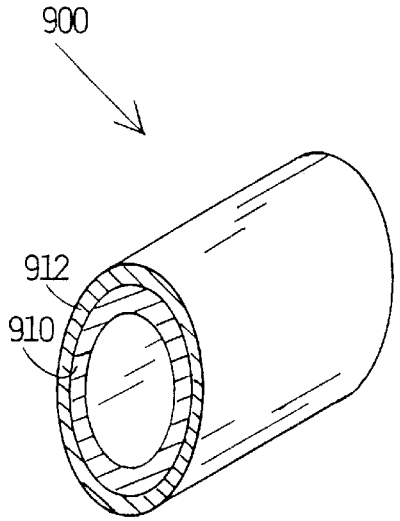
FIG. 9 is a schematic perspective view illustrating an elongate member connection restraint of the present invention.

In a further embodiment of the present invention, depicted on FIG. 9, an elongate member connection retainer 900 contains an inside layer 910 of a flexible foam inside a tube 912, for use with an elongate member (not shown). The dimensions of tube 912 and foam layer 910 are such that the outside diameter of the elongate member is intermediate between the inside diameter of the tube and the inside diameter of the foam layer. The foam layer is thus adapted for providing a close or snug fit between the retainer and an elongate member that is in a relaxed state as well as an elongate member that is in a stretched state. Suitable flexible foam materials include polymeric foams such as PE, PU and elastomeric foam.

Connection retainers of the present invention are preferably cylindrically shaped tubes. However, tubes having cross sectional configurations such as for example oblong, square, triangular or hexagonal are also suitable embodiments of the present invention.

Figure 10:
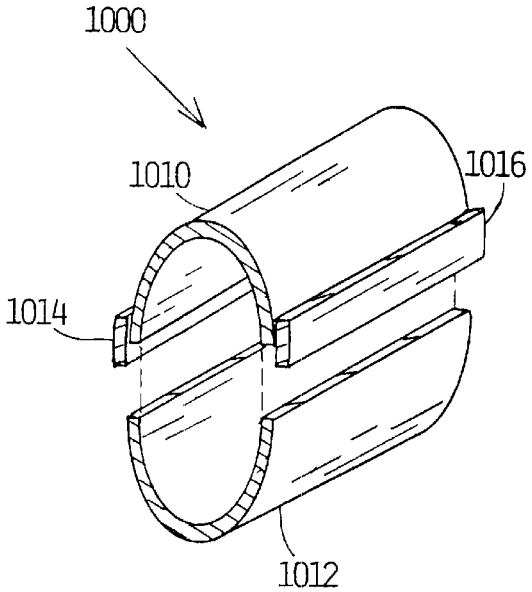
FIG. 10 is a schematic perspective view illustrating another elongate member connection restraint of the present invention.

Elongate member connections such as connection 720 of tie-down device 700, shown in FIG. 7, are not adapted for slidably receiving a connection retainer because a segment, such as segment 740, prevents slidably moving a retainer from the elongate member to the elongate member connection. It is therefore contemplated to provide a connection retainer 1000, shown in FIG. 10, comprising a first tube half section 1010 and a second tube half section 1012. Each of these tube half sections is adapted for surrounding approximately half of the circumference of an elongate member (not shown). The two sections are positioned (not shown) around an elongate member connection (not shown) and are then secured together, in order to form a stronger elongate member connection. Tube half sections 1010 and 1012 can be secured together through a variety of conventional means that are well known to a person of ordinary skill in the art. For example sections 1010 and 1012 can be secured together by flanges 1014 and 1016 that are attached to section 1010 and that provide a clamping force or a friction fit between the two sections when the two sections are fitted together around the elongate member connection (not shown). Preferably, a flexible foam layer is provided inside each tube half section, similar to foam layer 910 of retainer 900 (FIG. 9).

It is also contemplated to use tubes such as tube 816 (FIG. 8), tube 900 (FIG. 9) and tube 1000 (FIG. 10) as protective devices (not shown). The tube can be positioned on an elongate member, such as employed in embodiments of the present invention, in a position where the elongate member contacts a structure or an object. The tube can then be utilized to reduce marring or damaging the elongate member and/or the structure or the object.

Figure 11:
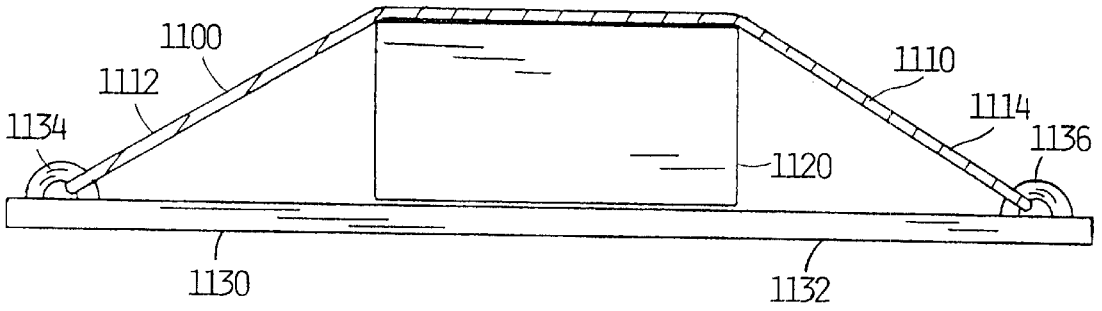
FIG. 11 is a schematic side view illustrating another device of the present invention.

As shown in FIG. 11, a tie-down device 1100 of the present invention is utilized to secure an object 1120 to a structure 1130. Structure 1130 includes a base 1132, a first attachment location 1134 and a second attachment location 1136. Both attachment locations are mounted on base 1132. Object 1120 is positioned intermediate the attachment locations. An elongate member 1110 of device 1100 is stretched across object 1120 and secured to attachment positions 1134 and 1136 employing the inventive techniques described in connection with FIGS. 4A, 4B, 6 and 7. Returning to FIG. 11, a first elongate member connection 1112 is formed proximal first attachment location 1134, while a second elongate member connection 1114 is formed proximal second attachment location. Optionally an elongate member retainer such as retainers 816, 900 and 1000 illustrated in FIGS. 8, 9 and 10 respectively, can be positioned around at least a portion of elongate member connections 1112 and/or 1114 shown in FIG. 11. The stretched condition of device 1100 provides a restraining force that secures object 1120 to structure 1130. Attachment positions include a variety of well known devices and supports, structures such as frames and structure mounted brackets, rings and hooks, that are typically used for positioning or tying an object to a support. It will be understood that FIG. 11 is merely illustrative of the many ways in which devices of the present invention can be employed to secure an object to a structure.

Elongate member 1110 of tie-down device 1100 (FIG. 11) is secured to two attachment positions, i.e. positions 1134 and 1136. However, tie-down devices of the present invention are also suitable for attachment to multiple attachment positions (not shown). For example tie-down device 700 (FIG. 7) is secured to attachment position 710. Additionally, segment 750 can be secured to another attachment position (not shown), while segment 740 can be secured to yet another attachment position (not shown). The elongate member can thus be stretched across two different portions of an object (not shown), without using fastening elements such as hooks or clips. In like manner, an elongate member of a tie-down device of the present invention can be secured to more than two or three attachment positions since the elongate member can be secured to itself at terminal portions as well as intermediate elongate member segments.

A variety of materials can be utilized to fabricate elongate members suitable for tie-down devices of the present invention. These materials include elongate member stock that comprises a flexible core (not shown) that is substantially non-elastic, combined with a core coating that is flexible. Suitable examples include a metal core, such as for example a conventional helical metal spring that is coated with for example a flexible polymeric material including polyethylene (PE) plasticized PVC (polyvinyl chloride), flexible PU (polyurethane) or elastomeric rubber. These coatings can be applied by means of a variety of conventional techniques such as (1) dipping the metal coil in a PVC plastisol followed by heat treatment, (2) spray coating the metal coil with a flexible thermosetting PU compound or (3) dipping the metal coil in a rubber latex solution, followed by drying the coated coil.

Suitable elongate members include coils that are fabricated by extruding a thermoplastic material on a non-elastic core such as for example a metal wire or a glass fiber bundle, and then forming the extruded product into a spiral or helix shaped configuration, for example around a capstan. These techniques are well known to persons of ordinary skill in the art. For example, see U.S. Pat. No. 4,425,292 (Kanotz, 1984) herein incorporated by reference.

Other suitable materials for elongate members of the present invention include polymer materials that are reinforced with a non-elastic fiber material such as glass fiber, carbon fiber or aramid fiber, and that are then formed into rods. See for example U.S. Pat. No. 4,883,552 (O'Connor et al., 1989) herein incorporated by reference. It is contemplated to form the '552 rods into helix or spiral structures for example using a capstan.

Additionally, suitable elongate members of the present invention include helix or spiral shaped configurations employing polymers that exhibit no substantial elasticity under conditions that are typical of securing an object to a structure. An example of such a polymer includes nylon that is prepared through a condensation reaction between hexamethylenediamine and adipic acid. The nylon can be extruded into a rod and formed into a helix or spiral shape using conventional techniques, in order to form elongate members of the present invention.

Suitable elongate member connection retainer tubes such as utilized in retainers 816 (FIG. 8), 900 (FIG. 9) and 1000 (FIG. 10) include rigid and flexible tubes. Examples of rigid tubes include metals and rigid plastics such as ABS (acrylonitrile butadiene styrene) and rigid PVC. Suitable flexible tubes include plasticized flexible PVC, flexible PU, PE (polyethylene) and elastomeric rubber. Preferably, retainer tubes of the present invention comprise flexible materials to prevent or minimize damage to the surface of objects and structures that are in contact with the retainer.

Examples of suitable foam materials for a retainer tube foam layer such as foam layer 910 of retainer 900 include flexible polymeric foam such as flexible open-cell PU foam, flexible PE foam and latex foam or sponge.

Preferably, side surfaces of coils of the present invention are provided with a slip resistant surface in order to enhance the strength of the elongate member connection since the connection includes coil half sections of a first elongate member segment that contact coil half sections of a second elongate member segment, as previously described in FIGS. 4B and 5. Coil side surfaces can be provided with a slip resistance for example by providing surfaces having grooves or surface formations such as diamond shaped surface formations on the side surfaces. These grooves and surface formations can for example be provided by passing the coil or helix stock between two rolls that impress the groove or surface formations on the coil side surfaces. This technique is particularly effective where the coil is provided with a thermoplastic coating and where the rolls are heated. Alternatively, coil side surfaces can be abraded using conventional techniques in order to prepare slip resistant side surfaces.

It is also contemplated to prepare slip resistant side surfaces by fabricating rubber dots on the coil side surfaces for example by using conventional techniques for spraying rubber latex droplets on the coil side surfaces and then drying the sprayed elongate members.

Additionally, coil side surfaces of elongate members of the present invention can be made slip resistant by applying a magnetic coating on the coil side surfaces, followed by magnetizing the coating. Examples of suitable magnetic materials such as magnetoplumbite powder, e.g. barium or strontium ferrite, and polymeric coating materials are disclosed in U.S. Pat. Nos. 4,308,155 (Tada et al., 1981) and 4,234,378 (Iwasaki et al. 1980) which are herein incorporated by reference.

The invention has been described in terms of the preferred embodiment. One skilled in the art will recognize that it would be possible to construct the elements of the present invention from a variety of means and to modify the placement of components in a variety of ways. While the embodiments of the invention have been described in detail and shown in the accompanying drawings, it will be evident that various further modifications are possible without departing from the scope of the invention as set forth in the following claims.

I claim:

1. A tie-down device comprising:

a) at least a first elongate member including multiple coils wherein the coils have substantially the same dimensions and configuration;

b) the first elongate member having (1) at least a first segment including one or more first segment coils and first segment coil half sections; and (2) at least a second segment including one or more second segment coils and second segment coil half sections;

c) the first segment secured upon the second segment, wherein a double helix first elongate member connection is formed;

d) the first elongate member connection comprising (1) the one or more first segment coils that alternate with the one or more second segment coils and (2) first segment coil half sections alternating with adjacent second segment coil half sections, wherein each of the first segment coil half sections is substantially parallel to each of the adjacent second segment coil half sections; and e) an elongate member connection retainer adapted for retaining at least a portion of the first elongate member therein wherein the retainer comprises: (1) a tube first half section having an inside layer of flexible foam, and (2) a tube second half section having an inside layer of flexible foam, such that the tube first and second half sections are adapted for fitting together around the first elongate member connection.

2. A tie-down device comprising:

a) at least a first single strand stretchable elongate member including multiple coils wherein the coils (1) have substantially the same dimensions, (2) have substantially the same configuration, (3) have a substantially circular cross section, (4) have side surfaces that are not permanently attached to side surfaces of adjacent coils, (5) have a coil configuration memory for substantially retaining the configuration of the elongate member, (6) include (i) coil half sections and (ii) a coil stock having a coil stock diameter and (7) are formed around an opening, such that the opening in each coil half section has an inside diameter that is at least equal to the approximate diameter of the coil stock;

b) the first elongate member having (1) at least a first segment including one or more first segment coils and first segment coil half sections, and (2) at least a second segment including one or more second segment coils and second segment coil half sections;

c) the first segment secured upon the second segment, wherein a double helix first elongate member connection is formed; and d) the first elongate member connection comprising (1) the one or more first segment coils that alternate with the one or more second segment coils and (2) first segment coil half sections alternating with adjacent second segment coil half sections, wherein each of the first segment coil half sections is substantially parallel to each of the adjacent second segment coil half sections.

3. The tie-down device of claim 2 additionally comprising elongate member stock including a metal spring having a flexible polymeric coating.

4. The tie-down device of claim 2 wherein the coils comprise elongate member stock including polymeric material reinforced with substantially non-elastic fiber material.

5. The tie-down device of claim 2 wherein the coils comprise nylon that is prepared through a condensation reaction between hexamethylenediamine and adipic acid.

6. The tie-down device of claim 2 additionally comprising coils having coil side surfaces that are provided with slip resistance.

7. The tie-down device of claim 2 additionally comprising an elongate member connection retainer, wherein the retainer is adapted for retaining at least a portion of the first elongate member connection therein.

8. The tie-down device of claim 7 wherein the retainer comprises a tube that is adapted for slidably fitting on the first elongate member.

9. The tie-down device of claim 7 wherein the retainer comprises a tube first half section and a tube second half section such that the tube first and second half sections are adapted for fitting together around the first elongate member connection, and wherein the tube first and second half sections are each adapted for surrounding approximately half of a first elongate member connection circumference.

10. The tie-down device of claim 2 additionally comprising:

a) the first elongate member having (1) a third segment including one or more third segment coils and third segment coil half sections and (2) a fourth segment including one or more fourth segment coils and fourth segment coil half sections;

b) the third segment secured upon the fourth segment, wherein a double helix second elongate member connection is formed; and c) the second elongate member connection comprising (1) the one or more third segment coils that alternate with the one or more fourth segment coils and (2) third segment coil half sections alternating with adjacent fourth segment coil half sections, wherein each of the third segment coil half sections is substantially parallel to each of the adjacent fourth segment coil half sections.

11. The tie-down device of claim 2 additionally comprising:

a) the first elongate member having a third segment including one or more third segment coils and third segment coil half sections;

b) a second elongate member having: (1) multiple coils wherein the coils have substantially the same dimensions and configuration as the coils of the first elongate member and (2) having a second elongate member segment including one or more second elongate member segment coils and second elongate member segment coil half sections;

c) the third segment secured upon the second elongate member segment, wherein a double helix second elongate member connection is formed; and d) the second elongate member connection comprising (1) the one or more third segment coils that alternate with the one or more second elongate member segment coils and (2) third segment coil half sections alternating with adjacent second elongate member segment coil half sections, wherein each of the third segment coil half sections is substantially parallel to each of the adjacent second elongate member segment coil half sections.

12. The device of claim 2 wherein the second segment does not include an end segment of the elongate member.

13. The device of claim 12 wherein the end segment includes six adjacent coils at a terminal end of the elongate member.

14. A tie-down device comprising:

a) at least a first elongate member including multiple coils wherein the coils have substantially the same dimensions and configuration;

b) the first elongate member having (1) at least a first segment including one or more first segment coils and first segment coil half sections, and (2) at least a second segment including one or more second segment coils and second segment coil half sections;

c) the first segment secured upon the second segment, wherein a double helix first elongate member connection is formed;

d) the first elongate member connection comprising (1) the one or more first segment coils that alternate with the one or more second segment coils and (2) first segment coil half sections alternating with adjacent second segment coil half sections, wherein each of the first segment coil half sections is substantially parallel to each of the adjacent second segment coil half sections; and e) an elongate member connection retainer adapted for retaining at least a portion of the first elongate member therein wherein the retainer comprises a tube including an inside layer of flexible foam.

15. A tie-down device comprising:

a) at least a first elongate member including multiple coils wherein the coils have substantially the same dimensions and configuration;

b) the first elongate member having (1) at least a first segment including one or more first segment coils and first segment coil half sections, and (2) at least a second segment including one or more second segment coils and second segment coil half sections;

c) the first segment secured upon the second segment, wherein a double helix first elongate member connection is formed;

d) the first elongate member connection comprising (1) the one or more first segment coils that alternate with the one or more second segment coils and (2) first segment coil half sections alternating with adjacent second segment coil half sections, wherein each of the first segment coil half sections is substantially parallel to each of the adjacent second segment coil half sections;

e) the first elongate member additionally having (1) a third segment including one or more third segment coils and third segment coil half sections and (2) a fourth segment including one or more fourth segment coils and fourth segment coil half sections;

f) the third segment secured upon the fourth segment, wherein a double helix second elongate member connection is formed;

g) the second elongate member connection comprising (1) the one or more third segment coils that alternate with the one or more fourth segment coils and (2) third segment coil half sections alternating with adjacent fourth segment coil half sections, wherein each of the third segment coil half sections is substantially parallel to each of the adjacent fourth segment coil half sections;

h) the first elongate member having (1) a fifth segment including one or more fifth segment coils and fifth segment coil half sections and (2) a sixth segment including one or more sixth segment coils and sixth segment coil half sections;

i) the fifth segment secured upon the sixth segment, wherein a double helix third elongate member connection is formed; and j) the third elongate member connection comprising (1) the one or more fifth segment coils that alternate with the one or more sixth segment coils and (2) fifth segment coil half sections alternating with adjacent sixth segment coil half sections, wherein each of the fifth segment coil half sections is substantially parallel to each of the adjacent sixth segment coil half sections.

16. A tie-down device comprising:

a) at least a first elongate member including multiple coils wherein the coils have substantially the same dimensions and configuration;

b) the first elongate member additionally comprising coils having side surfaces including magnetic coatings;

c) the first elongate member having (1) at least a first segment including one or more first segment coils and first segment coil half sections, and (2) at least a second segment including one or more second segment coils and second segment coil half sections;

d) the first segment secured upon the second segment, wherein a double helix first elongate member connection is formed; and e) the first elongate member connection comprising (1) the one or more first segment coils that alternate with the one or more second segment coils and (2) first segment coil half sections alternating with adjacent second segment coil half sections, wherein each of the first segment coil half sections is substantially parallel to each of the adjacent second segment coil half sections.

17. A tie-down device kit comprising:

a) a single strand stretchable elongate member having multiple coils wherein the coils have substantially the same dimensions and configuration and wherein the elongate member is adapted for forming a double helix elongate member connection; and b) an elongate member connection retainer that is adapted for slidably fitting on the double helix elongate member connection, and wherein the retainer is tube shaped.

18. The kit of claim 17 wherein the coils additionally comprise:

a) a substantially circular cross section;

b) a coil configuration memory for substantially retaining the configuration of the elongate member; and c) side surfaces that are not permanently attached to side surfaces of adjacent coils.

19. A method of securing a single strand stretchable elongate member upon itself, wherein the elongate member includes multiple coils that (1) have substantially the same dimensions, (2) have substantially the same configuration, (3) have a substantially circular cross section, (4) have side surfaces that are not permanently attached to side surfaces of adjacent coils, (5) have a coil configuration memory for substantially retaining the configuration of the elongate member, (6) include (i) coil half sections and (ii) a coil stock having a coil stock diameter and (7) are formed around an opening such that the opening in each coil half section has an inside diameter that is at least equal to the approximate diameter of the coil stock, the method comprising:

a) selecting a first segment of the elongate member having one or more first segment coils and first segment coil half sections;

b) selecting a portion of the first segment;

c) selecting a second segment of the elongate member having one or more second segment coils and second segment coil half sections;

d) selecting first and second adjacent coil half sections of the second segment;

e) positioning the first segment portion between the first and second coil half sections; and f) twisting the first and second segments together, forming an elongate member connection comprising: (1) one or more first segment coils that alternate with one or more second segment coils and (2) first segment coil half sections alternating with adjacent second segment coil half sections, wherein the first segment coil half sections are substantially parallel to the adjacent second segment coil half sections.

20. The method of claim 19 wherein forming the elongate member additionally comprises securing the elongate member to an attachment position.

21. The method of claim 19 additionally comprising slidably fitting a retainer on the elongate member.

22. The method of claim 21 wherein the retainer comprises a tube including an inside layer of flexible foam.

* * * * *